US011208857B2

(12) United States Patent
Soyland

(10) Patent No.: US 11,208,857 B2
(45) Date of Patent: Dec. 28, 2021

(54) PIPE GUIDE

(71) Applicant: Canrig Robotic Technologies AS, Sandnes (NO)

(72) Inventor: Svein Soyland, Kverneland (NO)

(73) Assignee: Canrig Robotic Technologies AS, Sandnes (NO)

( * ) Notice: Subject to any disclaimer, the term of this patent is extended or adjusted under 35 U.S.C. 154(b) by 234 days.

(21) Appl. No.: 16/354,899

(22) Filed: Mar. 15, 2019

(65) Prior Publication Data

US 2019/0284885 A1 Sep. 19, 2019

Related U.S. Application Data

(60) Provisional application No. 62/643,510, filed on Mar. 15, 2018.

(51) Int. Cl.

| | |
|---|---|
| ***E21B 19/24*** | (2006.01) |
| ***E21B 19/16*** | (2006.01) |
| ***E21B 19/06*** | (2006.01) |

(52) U.S. Cl.

CPC ..... *E21B 19/24* (2013.01); *E21B 19/06* (2013.01); *E21B 19/16* (2013.01)

(58) Field of Classification Search

CPC ..... E21B 19/06; E21B 19/16; E21B 19/24

See application file for complete search history.

(56) References Cited

U.S. PATENT DOCUMENTS

| | | | | |
|---|---|---|---|---|
| 3,603,387 | A | 9/1971 | Schoeffler | |
| 4,690,213 | A | 9/1987 | Stannard | |
| 5,597,041 | A | 1/1997 | Robinson | |
| 6,748,823 | B2 | 6/2004 | Pietras | |
| 7,090,254 | B1 | 8/2006 | Pietras et al. | |
| 8,955,620 | B2 | 2/2015 | Littlely et al. | |
| 2002/0088310 | A1 | 6/2002 | Pietras | |
| 2012/0168227 | A1 | 7/2012 | Littlely et al. | |
| 2016/0186510 | A1* | 6/2016 | Vestersjo | E21B 19/24 166/250.01 |

(Continued)

FOREIGN PATENT DOCUMENTS

| | | | |
|---|---|---|---|
| DE | 1229944 | B | 12/1966 |
| GB | 2345073 | A | 6/2000 |

(Continued)

OTHER PUBLICATIONS

International Search Report and the Written Opinion received from the International Searching Authority (ISA/EPO) for International Application No. PCT/GB2014/052453 dated Jun. 5, 2015, 10 pages.

*Primary Examiner* — George S Gray

(74) *Attorney, Agent, or Firm* — Abel Schillinger, LLP; Enrique Abarca

(57) ABSTRACT

A pipe guide comprising a first arm comprising a first set of guides; and a second arm comprising at least one guide, wherein all guides of the first set of guides are adapted to bias against an external portion of a pipe, and wherein a pressure of each of the guides against the pipe is adapted to be above a threshold pressure necessary to guide a secondary pipe relative to the pipe. In an embodiment, the first set of guides comprises a plurality of bodies and at least one of the bodies of the first set of guides is adapted to be rotatable about a rotational axis with respect to the first arm.

20 Claims, 6 Drawing Sheets

(56) References Cited

U.S. PATENT DOCUMENTS

2019/0136669 A1 5/2019 Wiedecke et al.

FOREIGN PATENT DOCUMENTS

| | | | |
|---|---|---|---|
| GB | 2420362 | B | 5/2007 |
| GB | 2472709 | B | 12/2012 |
| SU | 1198199 | A | 12/1985 |
| WO | 2002075097 | A2 | 9/2002 |
| WO | 2003031766 | A1 | 4/2003 |
| WO | 2009049006 | A3 | 4/2009 |
| WO | 2015019117 | A2 | 2/2015 |

* cited by examiner

PIPE GUIDE

CROSS-REFERENCE TO RELATED APPLICATION(S)

This application claims priority under 35 U.S.C. § 119(e) to U.S. Patent Application No. 62/643,510 entitled "Pipe Guide," by Svein SOYLAND, filed Mar. 15, 2018, which application is assigned to the current assignee hereof and incorporated herein by reference in its entirety.

FIELD OF THE DISCLOSURE

The present invention relates generally to a pipe guide, and more particularly to a pipe guide for use in aligning a plurality of pipe segments in a drill string.

RELATED ART

Drilling subterranean wells for oil and gas generally includes the use of a drilling rig coupled with a drill string comprised of a plurality of pipe segments. Each segment of pipe includes a generally annular sidewall defining an aperture. Typically, each segment is brought to the drill rig and added to the drill string in situ. Equipment transports the segments to the drilling platform where it is coupled to the drill string. The drill string is then urged by one or more components of the drill rig into a wellbore below. The oil and gas industry continues to demand improvements for attaching new pipe segments to drill strings for subterranean drilling operations.

BRIEF DESCRIPTION OF THE DRAWINGS

Embodiments are illustrated by way of example and are not limited in the accompanying figures.

DETAILED DESCRIPTION

Figure 1:
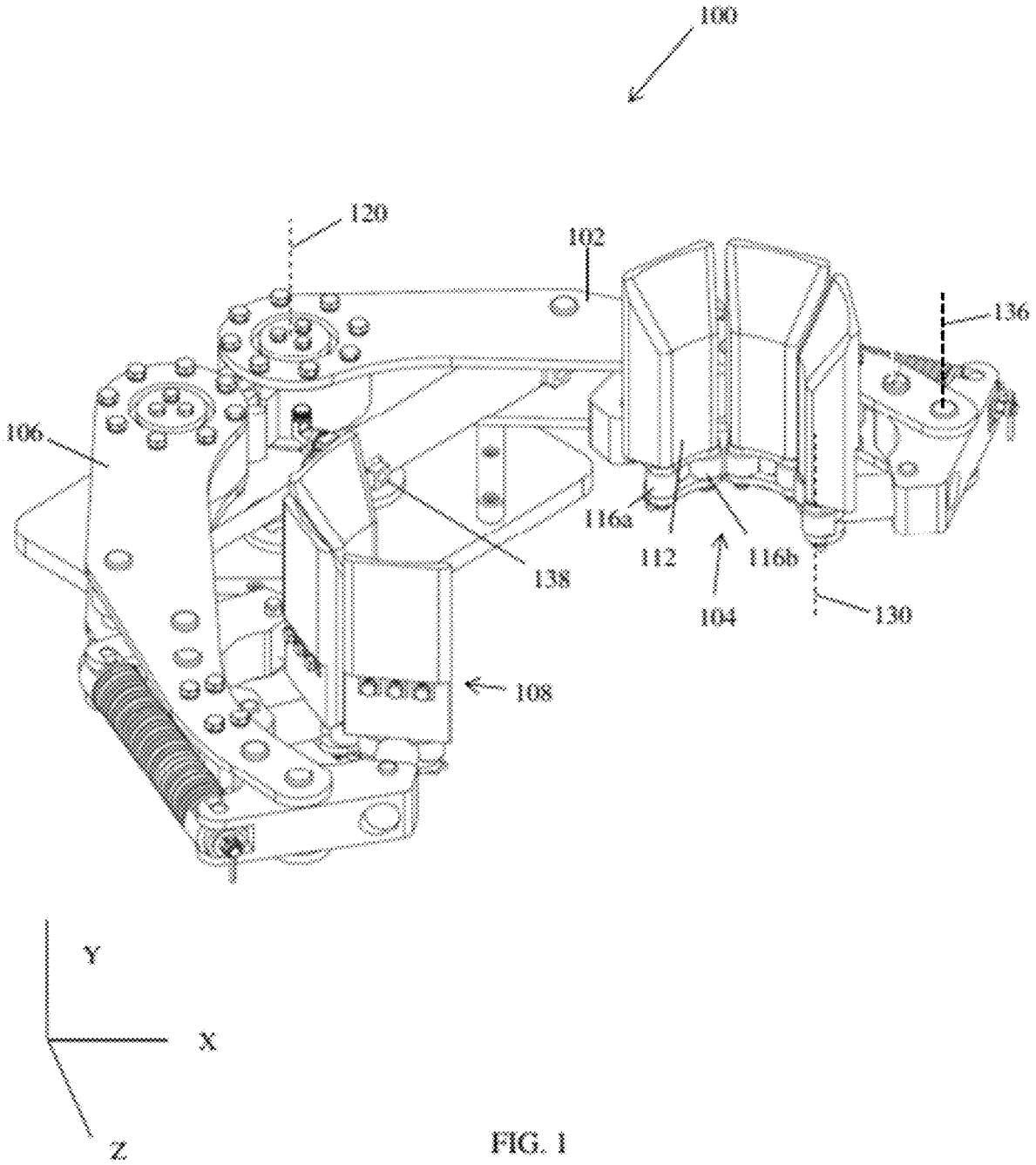
FIG. 1 includes a perspective view of a pipe guide in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

As used herein, "generally equal" and "generally same" refer to deviations of no greater than 10%, or no greater than 8%, or no greater than 6%, or no greater than 4%, or no greater than 2% of a chosen value. For more than two values, the deviation can be measured with respect to a central value. For example, "generally equal pressures" refer to two or more pressures that are no greater than 10% different in value. Demonstratively, two pressures of 30 PSI and 33 PSI are generally equal and three pressures of 45 PSI, 49 PSI, and 52 PSI are generally equal. Similarly, angles offset from one another by 98% are generally perpendicular. As used herein, "self-aligning" refers to the ability of one or more objects to align with a reference object, such as a pipe segment, without any externally-provided manual alignment input from an operator. For example, the inner surface of the guides can be adapted to self-align with an external surface of the pipe segment upon moving the first and second arms together with the pipe segment therebetween. As used herein, "vertical elevation" is generally described with respect to a Y-axis of an X, Y, Z field. In particular embodiments, the Y-axis may correspond with a central axis of a drill string to be operated on.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

Generally, subterranean drilling operations utilize a drill string constructed from thin-walled drill pipe segments connected to one another. Pipe segments are typically connected together by threaded connection at the surface of a wellbore. After coupling successive segments together, the drill string is urged or lowered into the wellbore. As the drilling commences, additional pipe segments are required to maintain a surface connection between the drill string and the drill rig. These pipe segments are coupled together at the surface, requiring alignment between successive segments. A pipe guide in accordance with one or more embodiments described herein can be used to align successive pipe segments.

Figure 2:
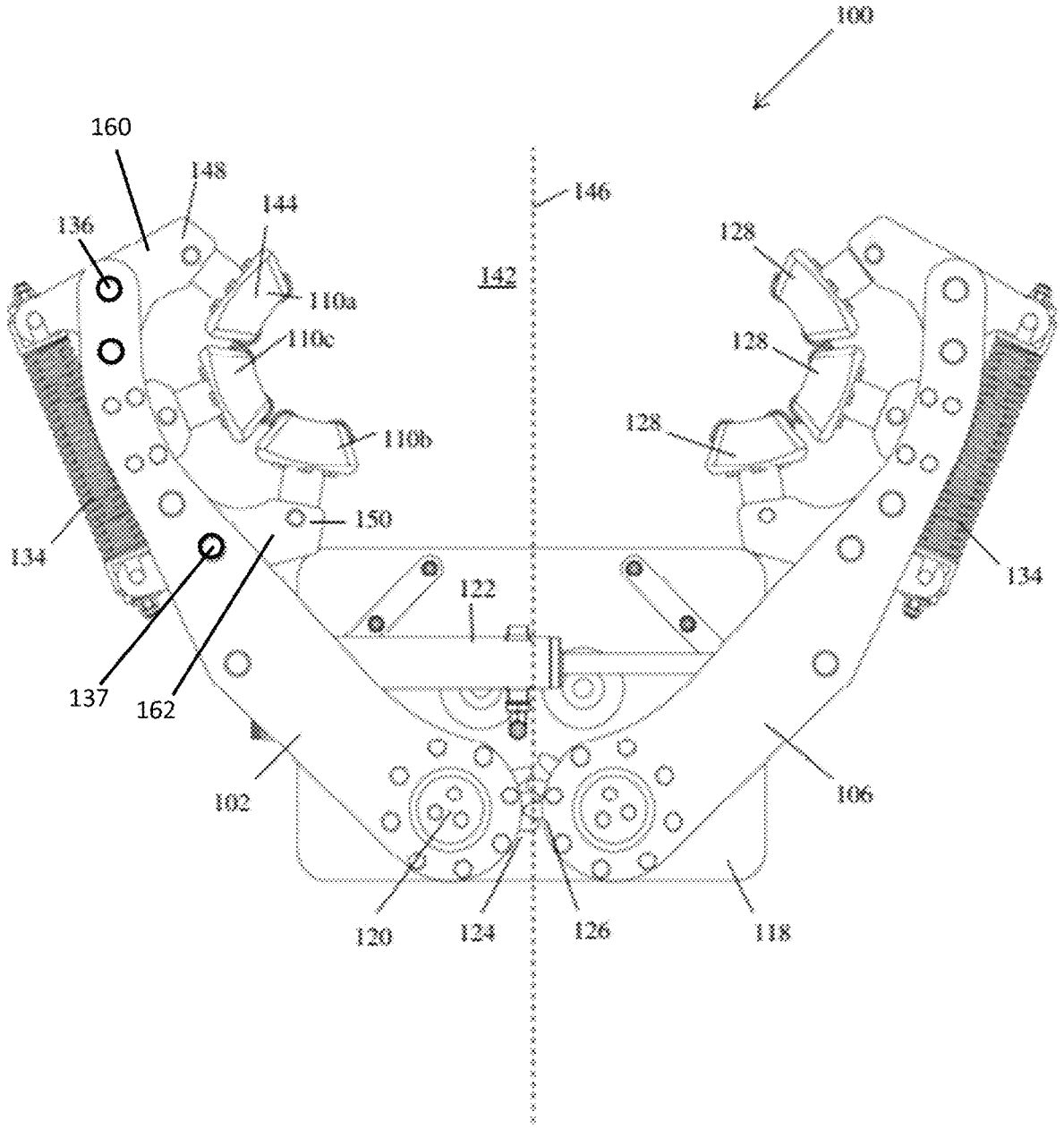
FIG. 2 includes a top view of a pipe guide in accordance with an embodiment as viewed in an open configuration.
Figure 3:
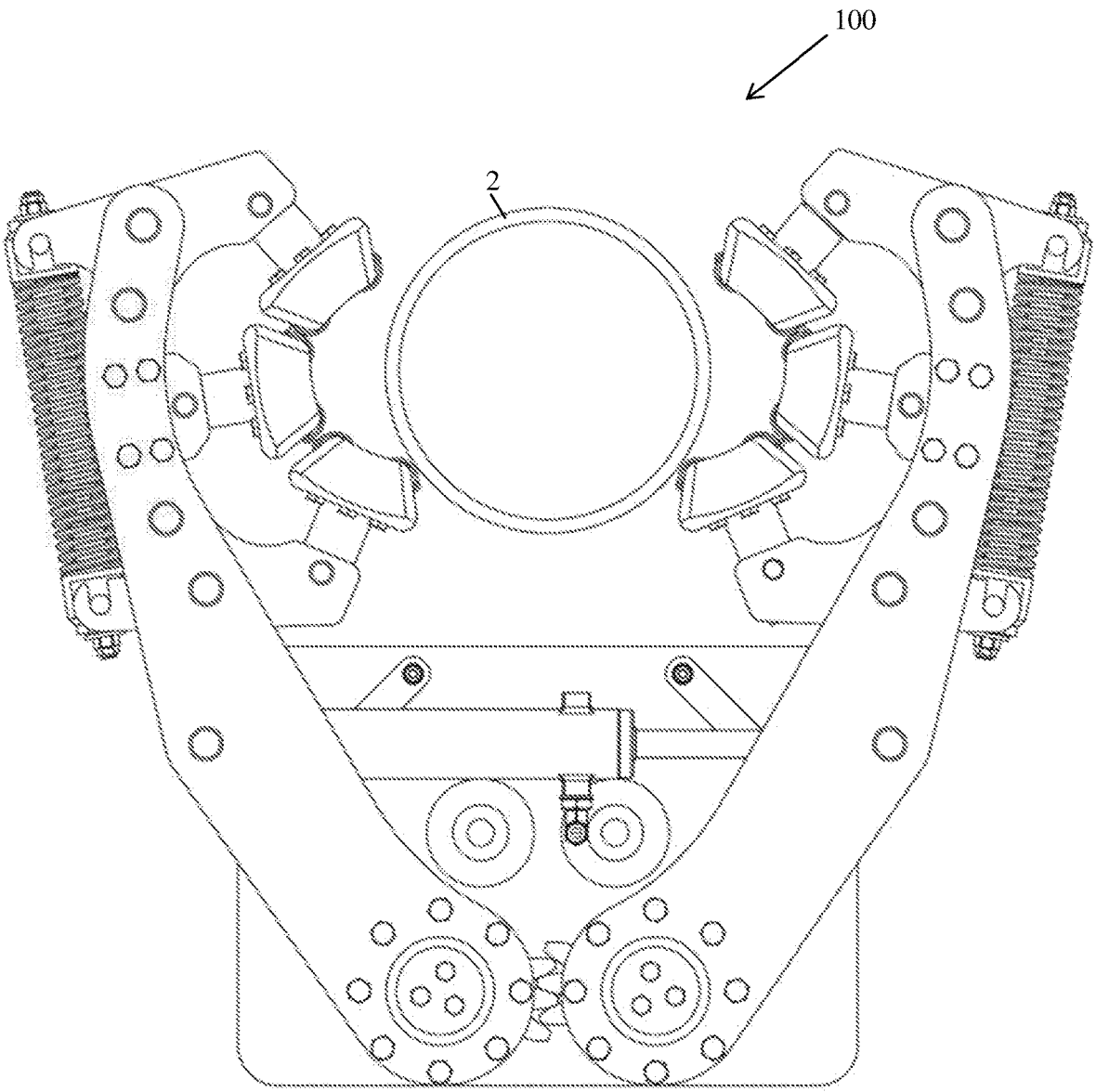
FIG. 3 includes a top view of the pipe guide in accordance with an embodiment as it moves between the open and closed configurations with a first pipe segment to be engaged.

Referring to FIGS. 1 to 3, a pipe guide 100 can be used to align successive pipe segments 2 (FIG. 3) in a drill string. The pipe guide 100 can generally include a first arm 102 with a first guide 104 and a second arm 106 with a second guide 108. At least one of the first and second arms 102 and 106 can be moveable with respect to a base 118 of the pipe guide 100. For example, the first and second arms 102 and 106 can be translated from an open configuration, wherein the pipe guide 100 is adapted to receive the pipe segment 2 into a guiding area 142 between the first and second arms 102 and 106 (e.g., FIGS. 2 and 3), and a closed configuration, wherein the pipe guide 100 is coupled to the pipe segment 2 (e.g., FIGS. 4 and 5).

The base 118 can be coupled to a movable component on the drill rig allowing the pipe guide 100 to move relative to the drill string. By way of example, the base 118 can be coupled with an arm (not illustrated) and moved relative to the drill string. In an embodiment, the base 118 is coupled to a movable component on the drill rig by a coupling with a tolerance. For example, the base 118 can be attached to the movable component by one or more bushings (not illustrated). In an embodiment, the bushings can be oversized to permit relative lateral movement between the base 118 and the movable component. In such a manner, the base 118 can be adapted to compensate for inaccuracies between the drill string and the drill rig, reducing unnecessary strain on the systems or the drill string.

The pipe guide 100 can be moved toward the drill string when a new pipe segment is to be added to the drill string, and conversely moved away from the drill string after the pipe segment has been aligned and at least partially coupled with a neighboring segment of pipe (i.e., the upper end of the existing drill string suspended in the wellbore).

In an embodiment, the first and second arms 102 and 106 of the pipe guide 100 can be coupled with the base 118. In a particular embodiment, the first arm 102 can be pivotally coupled about a pivot axis 120. The second arm 106 can also be coupled around a pivot axis (not illustrated). An actuator 122 can urge the first arm 102 to pivot on the pivot axis 120. In a particular embodiment, the actuator 122 can include a mechanical actuator, an electrical actuator, a pneumatic actuator, another suitable actuator, or any combination thereof. In a particular embodiment, the actuator 122 can include a linear actuator, a rotary actuator, another suitable actuator, or any combination thereof. In an embodiment, the actuator 122 can also urge the second arm 106 to pivot about its pivot axis (not illustrated). As the actuator 122 biases the first and second arms 102 and 106 together, the pipe guide 100 can move toward a closed configuration in which the pipe guide 100 is adapted for pipe segment alignment. Conversely, as the actuator 122 biases the first and second arms 102 and 106 apart, the pipe guide 100 can move toward an open configuration whereby the pipe guide 100 can be moved relative to the drill string.

In another embodiment, the actuator 122 can bias only the first arm 102. The pipe guide 100 can include a plurality of actuators including a second actuator (not illustrated) adapted to bias the second arm 106. In a first example, the first and second actuators can be linked to operate at the same speed as one another, thus biasing the first and second arms 102 and 106 equally. In a second example, the actuators can operate independently allowing them to move at a same speed or different speeds as compared to one another. In an embodiment, the first and second actuators can share a connection point (e.g., the first and second actuators can be coupled to a common pivot point of the base 118 and each extend to a different arm of the pipe guide 100). In another embodiment, the first and second actuators can be coupled to separate connection points.

In certain embodiments the pipe guide 100 can include a synchronizing element adapted to synchronize the rotational speeds of the first and second arms 102 and 106. By way of example, the synchronizing element can include a first synchronizing element 124 and a second synchronizing element 126. The first synchronizing element 124 can be coupled with, such as disposed on, the first arm 102 and the second synchronizing element 126 can be coupled with, such as disposed on, the second arm 106. In a particular embodiment, at least one of the first and second synchronizing elements 124 and 126 can be disposed at or adjacent a longitudinal end of the first or second arm 102 and 106. The first and second synchronizing elements 124 and 126 can interact with one another, for example through a stepped or toothed interface, to rotate the first and second arms 102 and 106 at generally equal speeds as compared to one another. In a particular embodiment, the first and second synchronizing elements 124 and 126 can include a plurality of gears adapted to equally transfer rotational movement between the first and second arms 102 and 106. More specifically, the first and second synchronizing elements 124 and 126 can affect equal movement of the first and second arms 102 and 106 as the actuator 122 translates the pipe guide 100 between open and closed configurations. In a particular instance, the synchronizing element can maintain the first and second arms 102 and 106 reflectively symmetrical in angular position relative to the pipe segment regardless of the relative position of the arms 102 and 106 between open and closed configurations. That is, both the first and second arms 102 and 106 can move equidistant from a centerline 146 of the pipe guide 100.

In an embodiment, the actuator 122 can be coupled to only one of the first or second arms 102 or 106. The synchronizing element can be adapted to transfer force from the first or second arm 102 or 104 to the other of the first or second arm 102 or 104. In a particular embodiment, transfer of force through the synchronizing element can be 1:1 such that the forces applied on the first and second arms 102 and 106 are equal, or generally equal, to one another. In another embodiment, the synchronizing element can include a gearing or offset (not illustrated) adapted to transfer force at a ratio different than 1:1. By way of non-limiting example, a force ratio between the first and second arms 102 and 106 can be in a range of 1:10 and 10:1, or in a range of 1:5 and 5:1, or in a range of 1:2 and 2:1.

In an embodiment, the first guide 104 can include a first set of guides including a plurality of guides 110, such as at least two guides, or at least three guides, or at least four guides, or at least five guides. In a further embodiment, the first guide 104 can include no greater than 50 guides, or no greater than 20 guides, or no greater than 10 guides. In an embodiment, the first guide 104 can include at least 2 and no greater than 20 guides, or at least 3 and no greater than 10 guides. The first guide 104 can include a number of guides in a range of between and including one guide and twenty guides, or two guides and fifteen guides, or three guides and ten guides. In another embodiment, the second guide 108 can include a at least one guide, such as a plurality of guides 128, such as at least two guides, or at least three guides, or at least four guides, or at least five guides. In a further embodiment, the second guide 108 can include no greater than 50 guides, or no greater than 20 guides, or no greater than 10 guides. The second guide 108 can include a number of guides in a range of between and including one guide and twenty guides, or two guides and fifteen guides, or three guides and ten guides.

In an embodiment, a number of guides in the plurality of guides 128 can be equal to a number of guides in the plurality of guides 110. In another embodiment, the number of guides in the plurality of guides 128 can be different from the number of guides in the plurality of guides 110. For example, the plurality of guides 110 can include at least 2 guides and no greater than 5 guides and the plurality of guides 128 can include at least 3 guides and no greater than 6 guides.

While the following description is made with respect to the first guide 104, it will be understood that the second guide 108 can have any number of similar or different features as compared to the first guide 104. For example, the first and second guide 104 and 108 can include a same number of guides 110 and 128 as one another.

In an embodiment, at least two of the guides 110 can be spaced apart from one another when the pipe guide 100 is in the open configuration, the closed configuration, or both. In a more particular embodiment, all of the guides 110 are spaced apart from one another. In yet a more particular embodiment, all of the guides 110 are equidistantly spaced apart from one another.

In an embodiment, at least one of the guides 110 can include a body 112 defining an inner surface 114. In a more particular embodiment, the at least one guide 110 can further include a bearing 116. The body 112 and bearing 116 can be coupled together.

In an embodiment, the bearing 116 defines a rotational axis 130 generally perpendicular to a major length of the first arm 102. The rotational axis 130 can be perpendicular to a translating direction of the first arm 102. More particularly, the rotational axis 130 of the bearing 116 can be adapted to lie along a line generally parallel with a central axis of the drill string 2.

In an embodiment, each guide 110 can include at least one bearing 116. In another embodiment, each guide can include a plurality of bearings 116, such as at least two bearings 116, or at least three bearings 116, or at least four bearings 116, or at least five bearings 116. In another embodiment, the guide 110 can include no greater than 50 bearings 116, or no greater than 25 bearings 116, or no greater than 10 bearings 116. In an embodiment, the plurality of bearings 116 can be spaced apart from one another. For example, a first bearing 116*a* can be disposed on a first end of the guide 110 and a second bearing 116*b* can be disposed at a second end of the guide 110 opposite the first end. In a particular embodiment, the first and second bearings 116*a* and 116*b* can be reflectively symmetrical in position about a center plane of the body 112 oriented normal to the inner surface 114. In a particular aspect, the use of reflectively symmetrical bearing location can enhance self-alignment described below. In another embodiment, at least two bearings 116 of the plurality of bearings 116 can be immediately adjacent to one another.

In an embodiment, at least two of the bearings 116 can be disposed at a same vertical elevation as one another. That is, the at least two bearings 116 can be disposed at a same relative position along a Y-axis in the X, Y, Z field illustrated in FIG. 1. In a further embodiment, all of the bearings 116 can be disposed at a same vertical elevation as one another. In another embodiment, at least two of the bearings 116 can be disposed at different vertical elevations as compared to one another as measured along the Y-axis.

In an embodiment, at least one of the bearings 116 is adapted to rotate freely. As used herein, "rotate freely" refers to a condition whereby the bearing 116 can rotate on its rotational axis 130 upon application of a translating force applied to a surface of the bearing 116. In an embodiment, at least two of the bearings 116 are adapted to rotate independently of one another. That is, the at least two bearings 116 can each rotate without causing the other of the at least two bearings 116 to rotate.

Figure 6:
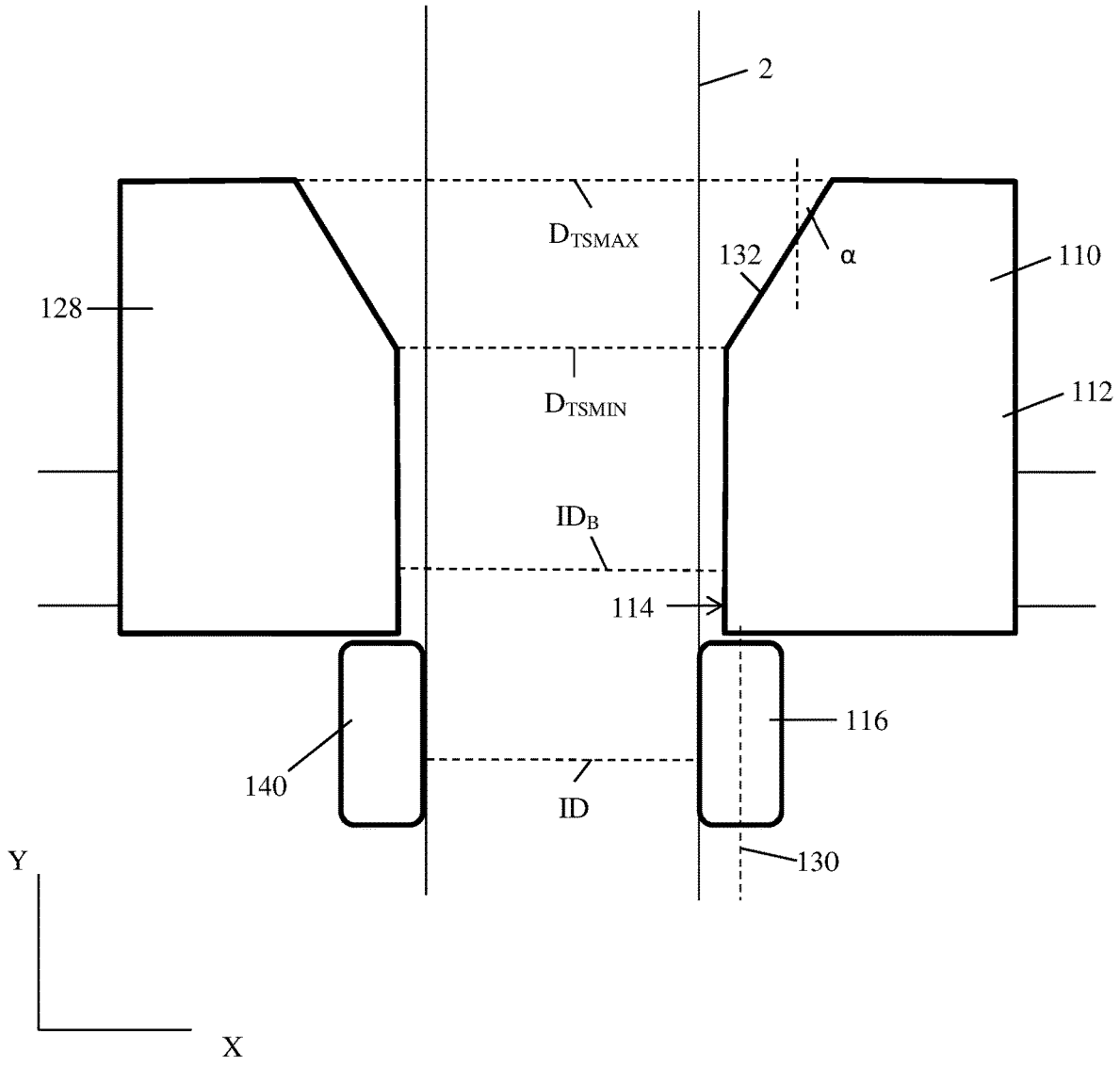
FIG. 6 includes a simplified cross-sectional side view of the pipe guide in accordance with an embodiment as viewed along line A-A in FIG. 4.

Referring to FIG. 6, in a particular embodiment, an inner diameter, ID, of the pipe guide 100, as viewed in the closed configuration, can be defined by an innermost edge of at least two of the bearings 116. In an embodiment, the inner diameter, ID, of the bearings 116 can be less than an inner diameter, $ID_B$, as measured between inner surfaces of opposite guides 110 and 128. In a more particular embodiment, an innermost portion of the bearings 116 can define the ID of the pipe guide 100. As the pipe guide 100 closes (i.e., moves from an at least partially open configuration to the closed configuration), the bearings 116 are adapted to contact the pipe segment 2 while the bodies 112 of the guide 110 are adapted to remain spaced apart therefrom. Thus, the inner surfaces 114 of the bodies 112 can be spaced apart from the pipe segment 2 when the pipe guide 100 is engaged with the pipe segment 2. In an embodiment, the bodies 112 of at least two, such as all, of the guides 110 can be spaced apart from the pipe segment 2 by equal distances. In another embodiment, nearest surfaces of the bodies 112 of at least two, such as all, of the guides 110 can be adapted to be spaced apart from the pipe segment 2 (in the closed configuration) by at least 1 mm, or at least 2 mm, or at least 3 mm, or at least 4 mm, or at last 5 mm, or at least 10 mm, or at least 20 mm, or at least 30 mm, or at least 40 mm, or at least 50 mm. In a further embodiment, the nearest surfaces can be spaced apart from the pipe segment 2 by no greater than 500 mm, or no greater than 250 mm, or no greater than 100 mm.

In an embodiment, at least one of the guides 110 can include a bearing 116 disposed at a vertical elevation below at least a portion of the body 112 of the at least one guide 110 as measured along the Y-axis. That is, an uppermost portion of the at least one guide 110 can be defined by the body 112 of the at least one guide 110.

In an embodiment, the body 112 can define a tapered surface 132 adapted to act as a ramp to guide a pipe segment into axial alignment with the drill string 2. The tapered surface 132 can define an angle, $\alpha$, as measured with respect to the Y-axis, of at least 1°, or at least 2°, or at least 3°, or at least 4°, or at least 5°, or at least 10°, or at least 15°, or at least 20°, or at least 25°, or at least 30°, or at least 35°, or at least 40°. In an embodiment, the angle, $\alpha$, is no greater than 85°, or no greater than 80°, or no greater than 75°, or no greater than 70°, or no greater than 65°, or no greater than 60°, or no greater than 55°, or no greater than 50°. The angle, $\alpha$, can be within a range between and including 1° and 85°, or 2° and 75°, or 5° and 50°, or 10° and 45°.

In an embodiment, the tapered surface 132 extends along the entire height of the body 112, as measured along Y-axis. In another embodiment, the tapered surface 132 can have a height of between and including 2% and 100% of the height of the body 112, or between and including 5% and 75% of the height of the body 112, or between and including 10% and 60% of the height of the body 112. In an embodiment, the tapered surface 132 can extend an entire distance between lateral side walls of the body 112. That is, in an embodiment, the tapered surface 132 can define the entire inner surface of the body 112 over a certain height of the body 112.

The tapered surface 132 of the guides 110 and 128, as viewed when the pipe guide 100 is in the closed configuration, can define a minimum diameter, $D_{TSMIN}$, and a maximum diameter, $D_{TSMAX}$. In an embodiment, the minimum diameter of the tapered surface 132 is disposed at a vertical elevation below the maximum diameter in the Y-axis, when the pipe guide 100 is in use. In a particular embodiment, the minimum diameter of the tapered surface 132 can be contiguous with the inner surface 114 of the body 112 of the guide 110.

In certain embodiments, at least one of the bearings 116 can be disposed at a vertical elevation below the tapered surface 132 when the pipe guide 100 is in use (i.e., when the pipe guide 100 is used to align pipes within a drill string). In a particular embodiment, at least one of the bearings 116 can be spaced apart from the tapered surface 132. In another embodiment, at least one of the bearings 116 can be at least partially disposed at a same vertical elevation as the tapered surface 132. In certain embodiments, all of the bearings 116 can be disposed at a generally same relative vertical elevation with respect to the pipe guide 100. In a more particular embodiment, all least two of the bearings 116, such as all of the bearings 116, can lie along a plane oriented normal, or generally normal, to the vertical axis of the pipe guide 100 when in operation.

In an embodiment, at least one of the bearings 116 can be disposed below the body 112 of the guide 110. In another embodiment, at least one of the bearings 116 can be disposed at least partially at a same vertical elevation as the body 112. By way of example, the at least one bearing 116 can be disposed radially inside of the inner surface 114 of the body 112. By way of another example, the at least one bearing 116 can be partially disposed within a cutout or recess of the body 112. In an embodiment, the axis of rotation of the bearing 116 can extend through the body 112 of the guide 110.

In an embodiment, a bearing 116 of the first guide 110 and a bearing 140 of the second guide 128 can define an inner diameter, ID, of the pipe guide 100, as seen in the closed configuration. The inner diameter, ID, can be less than the minimum diameter, $D_{TSMIN}$, of the body 112. In an embodiment, ID is no greater than 0.999 $D_{TSMIN}$, or no greater than 0.98 $D_{TSMIN}$, or no greater than 0.97 $D_{TSMIN}$, or no greater than 0.96 $D_{TSMIN}$, or no greater than 0.95 $D_{TSMIN}$, or no greater than 0.9 $D_{TSMIN}$, or no greater than 0.85 $D_{TSMIN}$. In another embodiment, ID is no less than 0.1 $D_{TSMIN}$, or no less than 0.15 $D_{TSMIN}$, or no less than 0.2 $D_{TSMIN}$, or no less than 0.25 $D_{TSMIN}$, or no less than 0.3 $D_{TSMIN}$. ID can also be within a range between and including 0.1 $D_{TSMIN}$ and 0.99 $D_{TSMIN}$, or 0.4 $D_{TSMIN}$ and 0.98 $D_{TSMIN}$, or 0.6 $D_{TSMIN}$ and 0.97 $D_{TSMIN}$.

In an embodiment, the bearing 116 can include a first material and the body 112 can include a second material different than the first material. For example, the first material can have a Vickers hardness greater than the Vickers hardness of the second material, or the first material can have a surface roughness less than a surface roughness of the second material, or the first material can have a porosity less than the porosity of the second material, or the first material can have a coefficient of friction different than a coefficient of friction of the second material, or any combination thereof. In a specific embodiment, the bearing 116 comprises a metal, alloy, polymer, or combination thereof. The bearing 116 can also include a lubricant, a filler material, or any combination thereof. The body 112 can comprise a metal, alloy, polymer, or any combination thereof.

In certain embodiments, the body 112 can include a low friction material, a low friction layer, or a low friction filler to permit easier sliding relative to a pipe segment to be guided into axial alignment with a drill string. The low friction material can include a material having a frictional coefficient less than a frictional coefficient of steel against steel. For example, the low friction material can include a fluorinated polymer, such as polytetrafluoroethylene. In an embodiment, the body 112 has a homogenous, or generally homogenous, material composition. In another embodiment, the body 112 can include one or more layers, such as an outer layer disposed over a centrally disposed material.

In an embodiment, at least one of the guides 110 is coupled to the first arm 102 through a pivotable linkage. Referring to FIG. 2, at least one of the guides 110 can be adapted to pivot relative to the first arm 102 about a pivot axis 136. The guide 110 can be pivotally coupled to the first arm 102 such that the guide 110 is operable within a relative range of rotation. In an embodiment, at least one of the guides 110 is adapted to pivot at least 5°, or at least 10°, or at least 15°, or at least 20°, or at least 25°, or at least 30°, or at least 35°, or at least 40°, or at least 45° about its pivot axis 136. In a further embodiment, at least one of the guides 110 is adapted to pivot no greater than 180°, or no greater than 160°, or no greater than 145°, or no greater than 125°, or no greater than 90°, or no greater than 75°, or no greater than 60° about its pivot axis 136. In another embodiment, at least one of the guides 110 can be adapted to pivot less than 360° relative to its pivot axis 136.

In an embodiment, the guide 110 can be spaced apart from the pivot axis 136 by a connective member 148. In another embodiment, all of the guides 110 can be spaced apart from their respective pivot axis (not illustrated) by connective members. In a further embodiment, the connective members 148 coupled to each guide 110 can have different lengths corresponding to the relative positions of the guides 110 with respect to the first arm 102.

In yet another embodiment, at least one of the guides 110 can be coupled to the first arm 102 by a pivotable linkage while at least one of the other guides 110 can be statically fixed to the first arm 102, i.e., without a pivotable linkage. Pivotable linkages of the guides 110 relative to the first arm 102 can allow the guides 110 to dynamically contact and translate with respect to one another upon contacting a pipe segment. The pivotable linkage can permit the guides 110 to displace away from one another upon contacting and urging against the pipe segment. This dynamic contact can permit enhanced gripping with the pipe which can mitigate pipe damage and protect against accidental pipe slippage or misalignment.

A biasing element 134 can be adapted to bias at least one of the guides 110. In a more particular embodiment, the biasing element 134 can be coupled between at least two of the guides 110. For example, in the illustrated embodiment the biasing element 134 extends between first and second guides 110*a* and 110*b*. In an embodiment, the biasing element 134 includes a spring, such as a helical spring, a hydraulic piston assembly, or another suitable biasing element. The biasing element 134 can exert biasing force on the first and second guides 110*a* and 110*b*. For example, the biasing element 134 can operate in a state of compression. That is, the biasing element 134 can bias the guides 110*a* and 110*b* toward one another at first ends 148 and 150 of the guides 110*a* and 110*b*. Through pivot axis 136, this biasing force can urge the bodies 114 of the guides 110 toward one another. In the closed configuration, the biasing element 134 is extended to its maximum extension, thereby rotating the arm 160 about the pivot axis 136 such that the end 148 is moved toward the end 150 of the arm 162, and rotating arm 162 about the pivot axis 137 such that the end 150 is moved toward the end 148 of the arm 160. Therefore, in the closed position, the guide 110*a* is biased toward the guide 110*b*.

As the pipe guide 100 moves toward the closed configuration and the guides 110 contact the drill string, the force of the drill string within the guiding area 142 against the guides 110 can cause the guides 110 to pivot about their respective pivot axis 136, compressing the biasing element 134. As the biasing element 134 compresses, the force exhibited at the interface between the biased guides 110*a* and 110*b* and drill string increases. During transition between the open and closed configurations, a pressure exerted by the first guide 110*a* on the drill string can be equal, or generally equal, to a pressure exerted by the second guide 110*b* on the drill string.

In the illustrated embodiment, the biasing element 134 is spaced apart from (i.e., not coupled to) a third guide 110*c* disposed between the first and second guides 110*a* and 110*b*. As the first arm 102 is moved toward the closed configuration the guides 110 contact the pipe segment. In an embodiment, the biasing element 134 is adapted to create a biasing force with a vector extending along a line generally perpendicular to a central axis of the pipe segment.

In an embodiment, the connective member 148 can be rotatably coupled to the guide 110. In an embodiment, at least one of the guides 110 can be adapted to rotate about a rotational axis 144. In a particular embodiment, the at least one guide 110 can be adapted to rotate at least 1°, or at least 2°, or at least 3°, or at least 4°, or at least 5°, or at least 10°, or at least 15°, or at least 20°, or at least 25°, or at least 30°, or at least 35°. In another embodiment, the at least one guide 110 can be adapted to rotate no greater than 90°, or no greater than 85°, or no greater than 80°, or no greater than 75°, or no greater than 70°, or no greater than 65°, or no greater than 60°, or no greater than 55°, or no greater than 50°, or no greater than 45°, or no greater than 40°. In a further embodiment, a plurality of guides 110 can be rotationally coupled to their respective connective members 148. In yet another embodiment, all of the guides 110 can be rotationally coupled to their respective connective members 148.

In accordance with an embodiment, at least one of the guides 110 of the first set of guides 104 is adapted to pivot about a pivot axis and rotate about a rotational axis. In a more particular embodiment, all of the guides of the first set of guides 104 are adapted to pivot about a pivot axis, or rotate about a rotational axis, or pivot about a pivot axis and rotate about a rotational axis.

In an embodiment, the pipe guide 100 can include a sensor 138 adapted to sense a physical condition of the pipe guide 100, pipe segment 2, or a combination thereof. In an embodiment, the sensor 138 is adapted to detect a physical condition of a pipe segment 2 with respect to the pipe guide 100. For example, the sensor 138 can sense a physical alignment of the pipe segment 2 relative to the pipe guide 100. The sensor 138 can sense when the pipe guide 100 is aligned with a pipe segment 2. The sensor 138 can sense the relative position of the first and second arms 102 and 106 with respect to the pipe segment 2. The sensor 138 can sense a physical parameter of the pipe segment 2, such as for example, a diameter of pipe segment 2, a surface characteristic of the pipe segment 2, or any other suitable characteristic or combination thereof. In an embodiment, the sensor 138 is disposed on the base 118 of the pipe guide 100. In another embodiment, the sensor 138 is disposed on one of the first and second arms 102 and 106. In a further embodiment, the sensor 138 can be disposed on the actuator 122. In a more particular embodiment, the sensor 138 can be coupled to the actuator, such as integrally attached with the actuator 122. In a more particular embodiment, the pipe guide 100 can include a plurality of sensors, such as at least two sensors. At least one of the sensors can be disposed on the first arm 102 and at least one of the sensors 138 can be disposed on the second arm 106. The sensor 138 can include a laser-based sensor, a visual sensor, an acoustic sensor, RFID transceiver, a mechanical or electrical sensor, another suitable sensor, or any combination thereof.

In an embodiment, the sensor 138 is adapted to communicate with a logic element (not illustrated) such as computer software. The sensor 138 can sense a physical parameter of the pipe guide 100 and communicate the sensed physical parameter to the logic element. In an embodiment, the logic element can communicate the sensed parameter to a drilling operator who can take action in response to the sensed parameter. For example, the drilling operator may move a pipe segment to the drill string after the pipe guide 100 is in the closed configuration around the existing drill string. In another embodiment, the logic element can take an action automatically upon occurrence of a predetermined physical parameter. For example, the logic element can automatically instruct the drill rig to move a pipe segment to the drill string after the pipe guide 100 is in the closed configuration around the existing drill string. In such a manner, the pipe guide 100 can be used as part of a closed loop drilling system while requiring less human interaction.

During operation, the pipe guide 100 is translated toward a pipe segment, e.g., a pipe segment of an existing drill string. The pipe guide 100 is generally positioned in the open configuration (FIG. 1) to permit entrance of the pipe segment into a guiding area 142 of the pipe guide 100 defined by the first and second arms 102 and 106. While not required, the pipe guide 100 can be in the fully open configuration during translation toward the pipe segment.

After translating the pipe guide 100 to a proper location relative to the drill string such that the drill string is within the guiding area 142, at least one of the first arm 102 and second arm 106 is biased to the closed configuration (FIG. 2) until at least one of the bearings 116 of at least one of the guides 110 contacts the drill string (FIG. 3). After initially contacting the drill string, the guides 110 can rotate on their pivot axis 136, rotational axis 144, or a combination thereof until the inner surface 114 of at least one of the guides 110 is tangent to an outer surface of the drill string. In an embodiment, biasing of the first and second arms 102 and 106 can be terminated once the inner surface of all of the guides 110 are tangent to an outer surface of the drill string.

In an embodiment, the bodies 112 of the guides 110 are spaced apart from the pipe segment 2 when the pipe guide 100 is in the closed configuration. For example, the inner surface 114 of at least one of the bodies 112 can be spaced apart from the pipe segment by at least 0.5 mm, or at least 1 mm, or at least 2 mm, or at least 3 mm, or at least 4 mm, or at least 5 mm, or at least 6 mm, or at least 7 mm, or at least 8 mm, or at least 9 mm, or at least 10 mm. In an embodiment, the inner surface 114 is spaced apart from the pipe segment by no greater than 1000 mm, or no greater than 250 mm, or no greater than 100 mm, or no greater than 50 mm.

In a particular embodiment, the guide 110 can align itself relative to the drill string such that the inner surfaces 114 of the bodies 112 of the guide 110 can all be equally, or generally equally, spaced apart from the drill string. In certain embodiments, use of a plurality of bearings 116 coupled to each body 112 may improve self-alignment characteristic of the guide 110 as the bearings 116 contact and slide or roll against the drill string until equal, or generally equal, pressure is transferred to the drill string from each of the bearings 116.

In an embodiment, a pressure of each of the guides 110 against the pipe 2 is adapted to be above a threshold pressure necessary to guide a secondary pipe relative to the pipe 2. In a more particular embodiment, all of the guides 110 are adapted to provide a pressure, e.g., bias, against an external portion of a pipe 2 that is no less than a threshold pressure necessary to guide a secondary pipe relative to the pipe 2. The threshold pressure may be different for different types of pipe. The threshold pressure is the pressure required to guide a pipe onto the drill string. Too little pressure, i.e., pressure below the threshold pressure, may not be sufficient to guide a pipe segment onto the drill string. For example, guides not adapted to provide the threshold pressure may give way upon urging of a pipe segment to the drill string. That is, the force of the pipe segment on the guide can cause the guide to give way, or move. As the guide gives way it can no longer sufficiently guide the pipe to the drill string as its guide surface is no longer aligned with the drill string. Moreover, the drill string might move relative to the guides if the guides are not providing a sufficient pressure thereagainst, thus preventing proper alignment of a pipe segment to the drill string. Conversely, too much pressure by one or more of the guides can mark the pipe segment, creating localized stress zones that might ultimately cause premature wear or failure. In traditional pipe guides, the guide surfaces are relatively fixed with respect to the guide assembly. That is, the guide surfaces are not capable of dynamically adjusting to the pipe being gripped. This can lead to some of the guides exhibiting less than a threshold pressure against the drill string as the surface characteristics, shape, and size of the drill string may vary between successive segments. This issue may be most pronounced for traditional pipe guides which handle pipes of various diameter or surface characteristic. Because traditional pipe guides cannot dynamically adjust location and angular position of their guide surfaces during the gripping process, some of the guides naturally exhibit pressures against the pipe less than the threshold pressure required to grip the pipe.

In an embodiment, at least two guides 110, such as all of the guides 110, are adapted to provide a generally equal pressure to an external portion of a pipe.

Biasing of the first and second arms 102 and 106 to the closed configuration is terminated after the guides 110 are rested firmly against the pipe segment of the drill string, after which point a new pipe segment is brought toward a distal end of the drill string. The pipe segment is then guided toward axial alignment with the drill string by the tapered surface of at least one guide of the first set of guides. The tapered surfaces 132 permit alignment of the pipe segment by guiding the pipe segment into axial alignment with the existing drill string. After contacting the drill string, the new pipe segment is secured therewith, typically by a threaded connection.

The sensor 138 can be adapted to sense a condition of the pipe segment added to the drill string. For example, the sensor 138 can sense when the new pipe segment is fully seated and connected with the drill string.

After joining the new pipe segment to the existing drill string, the first and second arms 102 and 106 can be moved from the closed configuration to the open configuration. The pipe guide 100 can then be translated away from the drill string and drilling operations can commence. In an embodiment, the pipe guide 100 can be stored between uses on the drill rig floor. In another embodiment, the pipe guide 100 can be part of an equipment suspended above the drill rig floor. The pipe guide 100 can be moved back toward the drill string when a next segment of pipe is to be added to the drill string.

In certain embodiments, pipe guides 100 in accordance with one or more embodiments described herein can be adapted to guide pipes of different sizes without requiring retooling or tool down time. That is, the pipe guide 100 may dynamically adjust to pipe segments of different sizes without requiring realignment or retooling. In a more particular embodiment, pipe guides 100 in accordance with one or more embodiments described herein can be adapted to accommodate pipes of various diameters. For example, the pipe guide 100 can be mounted on a first drill string having a first diameter (FIG. 4) and a second drill string with a second diameter different than the first diameter (FIG. 5) without retooling. In an embodiment, the bearings, or biasing elements, or rotatable guides, or any combination thereof can permit adaptable sizing capabilities without retooling.

Figure 4:
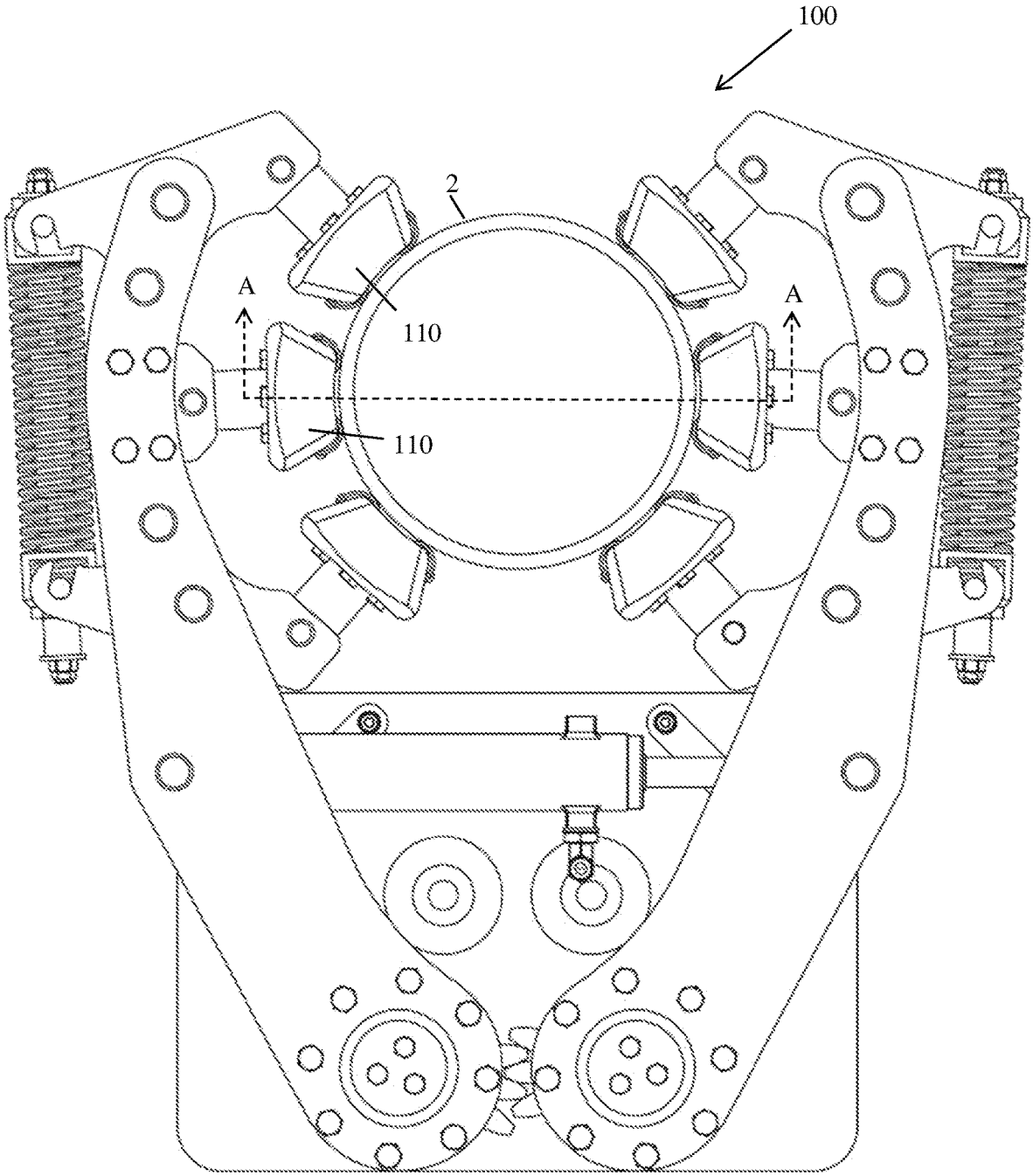
FIG. 4 includes a top view of the pipe guide in accordance with an embodiment in a closed configuration with the first pipe segment.
Figure 5:
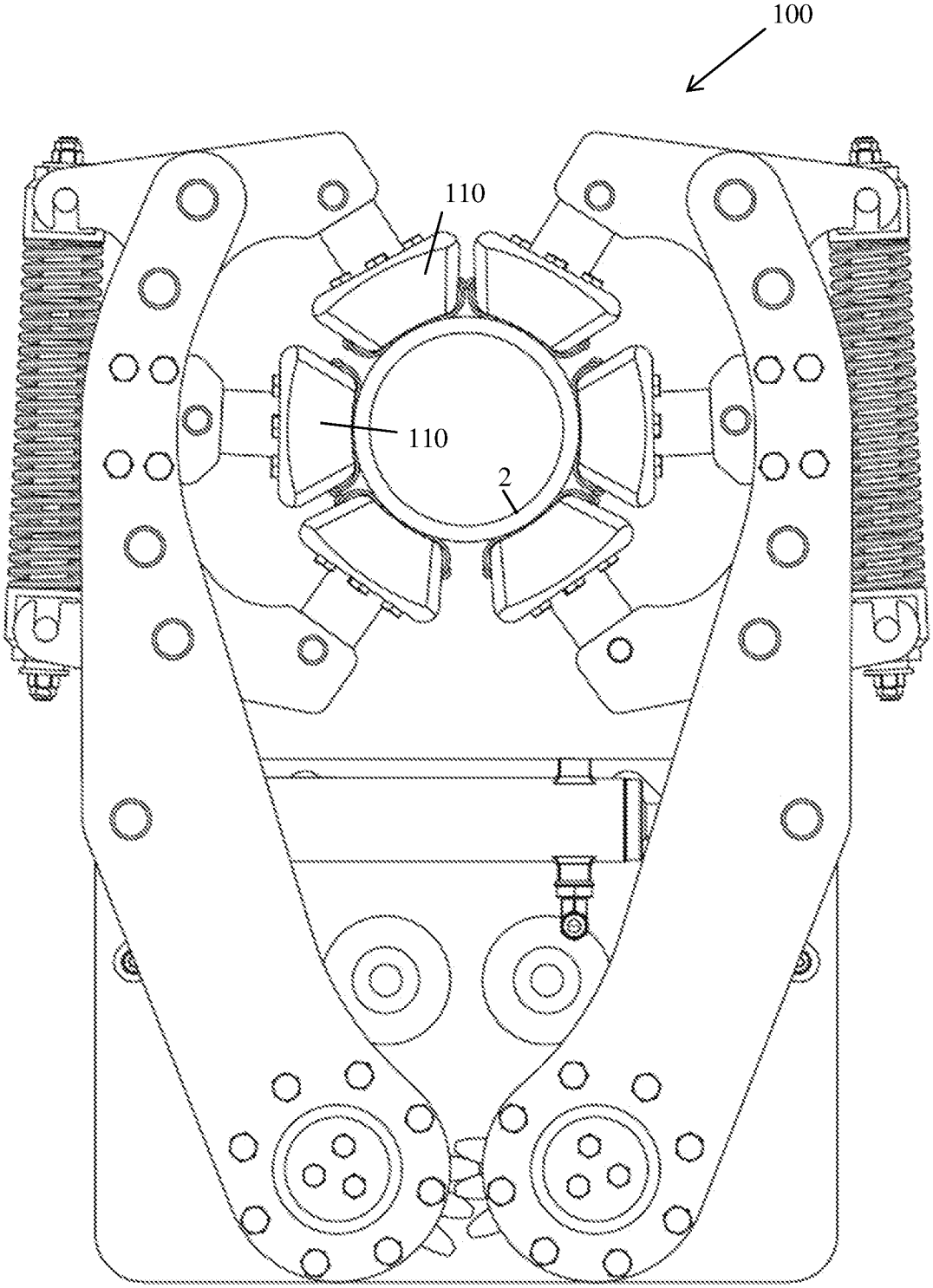
FIG. 5 includes a top view of the pipe guide in accordance with an embodiment in a closed configuration with a second pipe segment having a different dimension as compared to the first pipe segment.

As illustrated in FIGS. 4 and 5, the pipe guide 100 is adapted to accommodate a range of pipe diameters. For larger diameters (FIG. 4), the guides 110 of the pipe guide 100 can be spaced apart from one another by a first distance, as measured when the pipe guide 100 is in the closed configuration around the pipe 2. For smaller diameters (FIG. 5), the guides 110 of the pipe guide 100 can be spaced apart from one another by a second distance, as measured when the pipe guide 100 is in the closed configuration around the pipe 2. In an embodiment, the first distance is greater than the second distance. In a more particular embodiment, the first distance, $D_1$, is at least 1.01 $D_2$ (the second distance), or at least 1.02 $D_2$, or at least 1.03 $D_2$, or at least 1.04 $D_2$, or at least 1.05 $D_2$, or at least 1.1 $D_2$, or at least 1.2 $D_2$. In an embodiment, $D_1$ is no greater than 4 $D_2$, or no greater than 3 $D_2$, or no greater than 2 $D_2$.

In an embodiment, the pipe guide 100 is adapted to consecutively and uninterruptedly (i.e., without retooling) guide a first pipe with a first diameter and a second pipe with a second diameter onto one or more drill strings. The different diameters can be attributed to different gauge pipe, or accessories or specific features of the various pipes (e.g., surface features such as collars or equipment disposed on the pipe), or a combination thereof.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

EMBODIMENTS

Embodiment 1

A pipe guide comprising: a first arm comprising a first set of guides; and a second arm comprising at least one guide, wherein all guides of the first set of guides are adapted to bias against an external portion of a pipe, and wherein a pressure of each of the guides against the pipe is adapted to be above a threshold pressure necessary to guide a secondary pipe relative to the pipe.

Embodiment 2

A pipe guide comprising: a first arm comprising a first set of guides coupled to the first arm; and a second arm comprising at least one guide coupled to the second arm; wherein: the first set of guides comprises a plurality of bodies, and at least one of the bodies of the first set of guides is adapted to be rotatable about a rotational axis with respect to the first arm.

Embodiment 3

A pipe guide comprising: a first arm comprising at least one guide; and a second arm comprising at least one guide, wherein the first and second arms define a guiding area for a pipe, wherein at least one of the guide of the at least one guide of the first arm comprises a body and a bearing coupled to the body, and wherein the bearing defines an inner diameter of the guiding area.

Embodiment 4

The pipe guide of any one of embodiments 1 and 2, wherein at least one of the guides of the first set of guides comprises a bearing rotatably coupled to the body of the guide.

Embodiment 5

The pipe guide of any one of embodiments 3 and 4, wherein the bearing is disposed at a vertical elevation below the body of the guide.

Embodiment 6

The pipe guide of any one of embodiments 3-5, wherein the bearing defines an axis of rotation generally perpendicular to a major length of the first arm.

Embodiment 7

The pipe guide of any one of embodiments 3-6, wherein at least one of the guides of the second set of guides comprises a body and a bearing, and wherein the bearings of the first and second set of guides define an inner diameter less than an inner diameter of the body of the guide of the first or second set of guides.

Embodiment 8

The pipe guide of the preceding embodiments, wherein at least one guide of the first set of guides comprises a plurality of bearings.

Embodiment 9

The pipe guide of any one of the preceding embodiments, wherein the body of at least one of the guides of the first or second set of guides comprises a tapered surface.

Embodiment 10

The pipe guide of embodiment 9, wherein the tapered surface defines a minimum diameter and a maximum diameter, and wherein the minimum diameter is disposed at a vertical elevation below the maximum diameter when in use.

Embodiment 11

The pipe guide of any one of the preceding embodiments, wherein at least one guide of the first set of guides is coupled to a body of the first arm at least in part by a biasing element, or wherein at least two guides of the first set of guides are coupled to the body of the first arm at least in part by a biasing element, or wherein all of guides of the first set of guides are coupled to the body of the first arm at least in part by a biasing element.

Embodiment 12

The pipe guide of any one of the preceding embodiments, wherein at least one guide of the first set of guides is pivotably coupled to a body of the first arm, wherein the at least one guide of the first set of guides is adapted to pivot by at least 5°, or at least 10°, or at least 15°, or at least 20°, or at least 25°, or at least 30°, or at least 40°, wherein the at least one guide of the first set of guides is adapted to pivot by no greater than 180°, or no greater than 160°, or no greater than 145°, or no greater than 125°, or no greater than 90°, or no greater than 75°, or no greater than 60°.

Embodiment 13

The pipe guide of any one of the preceding embodiments, wherein at least one guide of the first set of guides is self-aligning.

Embodiment 14

The pipe guide of any one of the preceding embodiments, wherein the pipe guide is adapted to consecutively and uninterruptedly guide a first pipe with a first diameter and a second pipe with a second diameter.

Embodiment 15

The pipe guide of any one of the preceding embodiments, wherein the first set of guides comprises at least two guides, and wherein the at least two guides are spaced apart from one another, or independently self-aligning, or dynamically coupled together, or any combination thereof.

Embodiment 16

The pipe guide of any one of the preceding embodiments, further comprising an actuator adapted to bias the first arm and the second arm together.

Embodiment 17

The pipe guide of any one of the preceding embodiments, wherein the first arm comprises a first synchronizing element and the second arm comprises a second synchronizing element, and wherein the first and second synchronizing elements are coupled together such that the first and second arms rotate at a generally same speed upon opening and closing the pipe guide.

Embodiment 18

The pipe guide of any one of the preceding embodiments, wherein the pipe guide is adapted such that only the bearings of each pipe guide contact a pipe during an aligning operation between consecutive pipes.

Embodiment 19

The pipe guide of any one of the preceding embodiments, wherein the bearing of at least one of the first set of guides comprises a first material and the body of the at least one of the first set of guides comprises a second material, and wherein the first and second materials are different from one another, or wherein the first material is harder than the second material.

Embodiment 20

The pipe guide of any one of the preceding embodiments, further comprising a sensor adapted to detect a physical position of a pipe with respect to the pipe guide.

Embodiment 21

The pipe guide of any one of the preceding embodiments, wherein at least one of the first set of guides is adapted to rotate about an axis.

Embodiment 22

The pipe guide of embodiment 21, wherein the at least one guide of the first set of guides is adapted to rotate at least 1°, or at least 2°, or at least 3°, or at least 4°, or at least 5°, or at least 10°, or at least 15°, or at least 20°, or at least 25°, or at least 30°, or at least 35°, and wherein the at least one guide of the first set of guides is adapted to rotate no greater than 90°, or no greater than 85°, or no greater than 80°, or no greater than 75°, or no greater than 70°, or no greater than 65°, or no greater than 60°, or no greater than 55°, or no greater than 50°, or no greater than 45°, or no greater than 40°.

Embodiment 23

A method of guiding pipes comprising: translating a pipe guide toward a drill string; biasing at least one of first and second arms of the pipe guide together after the drill string is within a guiding area of the pipe guide, wherein the first arm comprises a first set of guides and the second arm comprises at least one guide, wherein at least one guide of the first set of guides comprises a body and a bearing, and wherein biasing is performed until at least one of the bearings contacts the drill string; after contacting the drill string, continuing to bias the at least one of the first and second arms toward the drill string, wherein biasing the at least one of the first and second arms toward the drill string is adapted to rotate at least one of the guides on a pivot axis, or a rotational axis, or a combination thereof; and terminating biasing of the first and second arms after the inner surface of at least one of the guides is tangent to an outer surface of the drill string.

Embodiment 24

The method of embodiment 23, further comprising: translating a new pipe segment toward a distal end of the drill string; guiding the new pipe segment toward axial alignment with the drill string; and contacting and securing the new pipe segment with the drill string.

Embodiment 25

The method of any one of embodiments 23 and 24, wherein guiding the new pipe segment is performed by channeling the new pipe segment through a tapered surface of at least one of the guides.

Embodiment 26

The method of any one of embodiments 23-25, wherein a pressure generated between the outer surface of the pipe and an inner surface of a first guide of the first set of guides is generally equal to a pressure generated between the outer surface of the pipe and an inner surface of a second guide of the first set of guides.

Embodiment 27

The method of any one of embodiments 23-26, wherein pressures generated between at least three of the guides and the outer surface of the pipe when the pipe guide is coupled with the first pipe are generally equal.

Embodiment 28

A pipe guide comprising:

a first arm comprising a first set of guides coupled to the first arm; and a second arm comprising at least one guide coupled to the second arm;

wherein:

the first set of guides comprises a plurality of bodies, and at least one of the bodies of the first set of guides is adapted to be rotatable about a rotational axis rotatable with respect to the first arm.

Embodiment 29

The pipe guide of embodiment 28, wherein at least one of the guides of the first set of guides comprises a bearing rotatably coupled to the body of the guide.

Embodiment 30

The pipe guide of embodiment 29, wherein the bearing is disposed at a vertical elevation below the body of the guide.

Embodiment 31

The pipe guide of embodiment 28, wherein the body of at least one of the guides of the first or second set of guides comprises a tapered surface, and wherein the tapered surface defines a minimum diameter and a maximum diameter, and wherein the minimum diameter is disposed at a vertical elevation below the maximum diameter when in use.

Embodiment 32

The pipe guide of embodiment 28, wherein the first arm comprises a first synchronizing element and the second arm comprises a second synchronizing element, and wherein the first and second synchronizing elements are coupled together such that the first and second arms rotate at a generally same speed upon opening and closing the pipe guide.

Embodiment 33

The pipe guide of embodiment 28, further comprising an actuator disposed on the pipe guide and adapted to bias the first arm and the second arm together.

Embodiment 34

The pipe guide of embodiment 28, wherein the first arm comprises a first synchronizing element and the second arm comprises a second synchronizing element, and wherein the first and second synchronizing elements are coupled together such that the first and second arms rotate at a generally same speed upon opening and closing the pipe guide.

Embodiment 35

The pipe guide of embodiment 28, further comprising a sensor adapted to detect a physical position of a pipe with respect to the pipe guide.

Embodiment 36

A pipe guide comprising:

a first arm comprising at least one guide; and a second arm comprising at least one guide, wherein the first and second arms define a guiding area for a pipe, wherein the at least one guide of the first arm comprises a body and a bearing coupled to the body, and wherein the bearing defines an inner diameter of the guiding area.

Embodiment 37

The pipe guide of embodiment 36, wherein the bearing is disposed at a vertical elevation below the body of the guide.

Embodiment 38

The pipe guide of embodiment 36, wherein the bearing defines an axis of rotation generally perpendicular to a major length of the first arm.

Embodiment 39

The pipe guide of embodiment 36, wherein the bearing is adapted facilitate movement of the at least one guide with respect to the pipe.

Embodiment 40

The pipe guide of embodiment 36, wherein the at least one guide of the first arm comprises a plurality of guides, and wherein at least two of the plurality of guides are interconnected by a biasing element.

Embodiment 41

The pipe guide of embodiment 40, wherein the plurality of guides comprises end guides and a middle guide disposed between the end guides, and wherein the end guides are biased together by the biasing element.

Embodiment 42

The pipe guide of embodiment 36, wherein at least one guide of the first set of guides is self-aligning.

Embodiment 43

The pipe guide of embodiment 36, wherein the pipe guide is adapted to consecutively and uninterruptedly guide a first pipe with a first diameter and a second pipe with a second diameter.

Embodiment 44

The pipe guide of embodiment 36, wherein the pipe guide is adapted to contact a pipe only at the bearing during an aligning operation between consecutive pipes.

Embodiment 45

The pipe guide of embodiment 36, further comprising a sensor adapted to detect a physical position of a pipe with respect to the pipe guide.

Embodiment 46

A method of guiding pipes comprising:

translating a pipe guide toward a drill string;

moving at least one of first and second arms of the pipe guide together after the drill string is within a guiding area of the pipe guide;

after contacting the drill string, continuing to move the at least one of the first and second arms toward the drill string so as to rotate a guide of the pipe guide around a pivot axis, a rotational axis, or both; and terminating relative movement between the first and second arms after the inner surface of at least one of the guides is tangent to an outer surface of the drill string to permit guiding operations associated therewith.

Embodiment 47

The method of embodiment 46, further comprising:

translating a new pipe segment toward a distal end of the drill string;

guiding the new pipe segment toward axial alignment with the drill string; and contacting and securing the new pipe segment with the drill string.

The invention claimed is:

1. A pipe guide comprising:

a base;

a first arm rotationally coupled to the base at a first pivot axis, the first arm comprising a first set of guides;

a second arm rotationally coupled to the base at a second pivot axis, the second arm comprising at least one second guide; and an actuator configured to rotate the first arm and the second arm relative to each other and relative to the base, wherein:

the first set of guides is positioned on one side of a guiding area and the at least one second guide is positioned on an opposite side of the guiding area, each one of the first set of guides and the at least one second guide comprises a body, and at least one of the first set of guides is rotationally coupled to the first arm at a third pivot axis, such that the at least one of the first set of guides is adapted to rotate about the third pivot axis with respect to the first arm, wherein the third pivot axis is parallel to the first and second pivot axes.

2. The pipe guide of claim 1, wherein the at least one of the first set of guides comprises a bearing rotatably coupled to the body of the at least one of the first set of guides.

3. The pipe guide of claim 2, wherein the bearing is disposed at a vertical elevation below the body of the at least one of the first set of guides.

4. The pipe guide of claim 1, wherein the body of the at least one of the first set of guides comprises a first tapered surface and the body of the second guide comprises a second tapered surface, wherein the body of the at least one of the first set of guides is positioned on an opposite side of the guiding area than the body of the at least one second guide, wherein the first tapered surface of the body of the at least one of the first set of guides and the second tapered surface of the body of the at least one second guide defines a minimum diameter and a maximum diameter that surround at least a portion of the guiding area, and wherein the minimum diameter is disposed at a vertical elevation below the maximum diameter.

5. The pipe guide of claim 1, wherein the first arm comprises a first gear rotationally fixed to an end of the first arm and the second arm comprises a second gear rotationally fixed to an end of the second arm, and wherein the first gear engages the second gear and synchronizes rotation of the first arm with rotation of the second arm, such that the first and second arms rotate at generally the same speed when the actuator extends or retracts.

6. The pipe guide of claim 1, wherein the first set of guides comprises a third guide rotationally coupled to the first arm and a fourth guide rotationally coupled to the first arm, wherein a biasing device bias the third guide toward the fourth guide, and wherein the biasing device is one of a spring or a hydraulic piston assembly.

7. The pipe guide of claim 6, wherein rotation of the first arm to a closed configuration rotates the third guide away from the fourth guide, and rotation of the first arm to an open configuration rotates the third guide toward the fourth guide.

8. The pipe guide of claim 1, further comprising a sensor adapted to detect a physical position of a pipe with respect to the pipe guide.

9. A pipe guide comprising:

a base; and a first arm rotationally coupled to the base at a first pivot axis, the first arm comprising a first set of guides, with the first set of guides comprising at least a first guide and a second guide, the first guide and the second guide being rotationally coupled to the first arm, wherein a biasing element is coupled to the first guide and the second guide, wherein the biasing element biases the first guide toward the second guide, and wherein the biasing element is one of a spring or a hydraulic piston assembly.

10. The pipe guide of claim 9 further comprising a second arm rotationally coupled to the base at a second pivot axis, the second arm comprising a second set of guides, which are positioned on an opposite of a guiding area from the first set of guides.

11. The pipe guide of claim 10, further comprising an actuator configured to rotate the first arm and the second arm between closed and open configurations.

12. The pipe guide of claim 11, wherein the first set of guides and the second set of guides are configured to engage a drilling string in the guiding area in the closed configuration, and wherein engagement with the drilling string counteracts the biasing element and rotates the first guide away from the second guide.

13. The pipe guide of claim 12, wherein each guide of the first set of guides comprising a body and a bearing with the bearing being rotationally coupled to the body.

14. The pipe guide of claim 13, wherein the bearing rotates about a rotational axis that is generally parallel to the first pivot axis.

15. The pipe guide of claim 14, wherein the bearings of the first and second sets of guides contact a drilling string when the pipe guide is in the closed configuration, with the bearings maintaining a gap between the bodies of the first and second sets of guides and the drilling string.

16. A method of operating a pipe guide comprising:

positioning a drill string within a guiding area of the pipe guide, the pipe guide comprising a first arm rotationally attached to a base and a second arm rotationally attached to the base;

rotating the first arm and the second arm toward a closed configuration of the pipe guide;

engaging the drill string with first and second guides of the first arm, with the first and second guides being rotationally coupled to the first arm; and rotating the first guide away from the second guide due to the engagement of the first and second guides with the drill string, while the first arm rotates toward the closed configuration.

17. The method of claim 16, further comprising:

engaging the drill string with third and fourth guides of the second arm, with the third and fourth guides being rotationally coupled to the second arm;

rotating the third guide away from the fourth guide due to the engagement of the third and fourth guides with the drill string, while the second arm rotates toward the closed configuration.

18. The method of claim 17, guiding a pipe segment into alignment with the drill string via the first, second, third, and fourth guides, with the first and second arms being positioned in the closed configuration.

19. The method of claim 18, further comprising:

rotating the first arm and the second arm toward an open configuration of the pipe guide;

disengaging the first and second guides from the drill string; and biasing, via a first biasing element, the first guide toward the second guide, wherein the first biasing element is one of a spring or a hydraulic piston assembly.

20. The method of claim 19, further comprising:

disengaging the third and fourth guides from the drill string; and biasing, via a second biasing element, the third guide toward the fourth guide, wherein the second biasing element is one of a spring or a hydraulic piston assembly.

* * * * *